US010421244B2

(12) United States Patent
Markovich et al.

(10) Patent No.: US 10,421,244 B2
(45) Date of Patent: Sep. 24, 2019

(54) HYDRAULIC FEEDER SYSTEM HAVING COMPRESSION STAGE WITH MULTI-CYLINDER HYDRAULIC CIRCUIT

(71) Applicant: ThermoChem Recovery International, Inc., Baltimore, MD (US)

(72) Inventors: Milan John Markovich, Pittsburgh, PA (US); David G. Newport, Cumberland, ME (US); Hamilton Sean Michael Whitney, Baltimore, MD (US)

(73) Assignee: ThermoChem Recovery International, Inc., Baltimore, MD (US)

( * ) Notice: Subject to any disclaimer, the term of this patent is extended or adjusted under 35 U.S.C. 154(b) by 679 days.

(21) Appl. No.: 15/086,353

(22) Filed: Mar. 31, 2016

(65) Prior Publication Data

US 2016/0207273 A1 Jul. 21, 2016

Related U.S. Application Data

(63) Continuation of application No. 14/775,071, filed as application No. PCT/US2013/035616 on Apr. 8, 2013, now Pat. No. 10,336,027.

(51) Int. Cl.

| | |
|---|---|
| ***B30B 9/30*** | (2006.01) |
| ***B30B 15/16*** | (2006.01) |
| ***B30B 15/22*** | (2006.01) |

(52) U.S. Cl.

CPC ..... *B30B 9/3057* (2013.01); *B30B 15/16* (2013.01); *B30B 15/22* (2013.01)

(58) Field of Classification Search

CPC .. B30B 1/32; B30B 1/34; B30B 15/16; B30B 15/22; B30B 9/30; B30B 9/3057; B09B 3/00; B27N 3/20; F23K 3/00

(Continued)

(56) References Cited

U.S. PATENT DOCUMENTS 2,192,778 A 11/1935 Stacy
2,616,265 A 8/1949 Wilson (Continued)

FOREIGN PATENT DOCUMENTS

CN 2176235 Y 9/1994
CN 101392809 A 3/2009

(Continued)

OTHER PUBLICATIONS

Extended European Search Report dated Oct. 20, 2016, issued in European counterpart application (No. 13881855.4).

(Continued)

*Primary Examiner* — Jimmy T Nguyen

(74) *Attorney, Agent, or Firm* — Womble Bond Dickinson (US) LLP

(57) ABSTRACT

A feeder system for advancing a compressible material has a hydraulic circuit associated with a final compression stage. The hydraulic circuit includes a platen attached to a primary ram configured to travel within a primary cylinder. The platen is operatively connected to a main piston cylinder assembly and at least two ancillary piston cylinder assemblies. In a first mode of operation, the hydraulic circuit forces the ancillary piston cylinder assemblies to advance the platen and ram in a forward compression direction until they reach a first predetermined position between travel extremes, while the main piston cylinder assembly passively travels along in the forward compression direction. Once the first predetermined position is reached, in a second mode of operation, the hydraulic circuit additionally forces the main piston cylinder assembly to compress the compressible material. In a third mode of operation, the hydraulic circuit retracts the platen and primary ram.

19 Claims, 7 Drawing Sheets

STEP 2: PRESSURIZE

(58) Field of Classification Search
USPC ..... 100/269.01, 269.06
See application file for complete search history.

(56) References Cited

U.S. PATENT DOCUMENTS

| | | | | |
|---|---|---|---|---|
| 3,554,117 | A | 1/1971 | Goldkuhle | |
| 3,693,541 | A * | 9/1972 | Lombard | B30B 9/3007 100/137 |
| 4,080,889 | A * | 3/1978 | Shiloni | B30B 9/3032 100/219 |
| 4,283,929 | A | 8/1981 | Heiberger | |
| 4,759,280 | A | 7/1988 | Malashenko | |
| 5,868,067 | A | 2/1999 | Patton et al. | |
| 6,168,305 | B1 | 1/2001 | Marmsater | |
| 6,186,373 | B1 | 2/2001 | Johanson | |
| 7,191,919 | B2 | 3/2007 | Ricciardi, Sr. et al. | |
| 7,600,960 | B2 | 10/2009 | Christensen et al. | |
| 7,655,215 | B2 | 2/2010 | Klepper | |
| 7,845,516 | B2 | 12/2010 | Pessin et al. | |
| 7,964,004 | B2 | 6/2011 | Koch et al. | |
| 8,100,066 | B2 | 1/2012 | Stein | |
| 8,198,339 | B2 | 6/2012 | Kiss | |
| 8,480,336 | B2 | 7/2013 | Krebs | |
| 8,721,299 | B2 | 5/2014 | Koch et al. | |
| 8,726,800 | B2 | 5/2014 | Murray et al. | |
| 9,056,294 | B2 | 6/2015 | Fink et al. | |
| 2002/0062676 | A1 | 5/2002 | Yashima et al. | |
| 2009/0130003 | A1 | 5/2009 | Koch et al. | |
| 2011/0011283 | A1 | 1/2011 | Burke | |
| 2011/0116986 | A1 * | 5/2011 | Balint | C10B 49/04 422/198 |
| 2011/0162741 | A1 | 7/2011 | Fink et al. | |
| 2012/0213647 | A1 | 8/2012 | Koch et al. | |
| 2013/0313481 | A1 | 11/2013 | Perez | |

FOREIGN PATENT DOCUMENTS

| | | | |
|---|---|---|---|
| DE | 3318188 | A1 | 11/1984 |
| DE | 102011011750 | A1 | 8/2012 |
| GB | 1039517 | A | 8/1996 |
| WO | WO 00/76757 | | 12/2000 |

OTHER PUBLICATIONS

International Search Report dated Jul. 10, 2013 issued in PCT counterpart application (No. PCT/US2013/035616).

Written Opinion dated Jul. 10, 2013 issued in PCT counterpart application (No. PCT/US2013/035616).

International Preliminary Report on Patentability (IPRP) dated Mar. 26, 2015 issued in PCT counterpart application (No. PCT/US2013/035616).

Office Action dated Jul. 5, 2016 issued in Chinese counterpart application (No. 201380077245.8).

* cited by examiner

STEP 1: ADVANCE

STEP 2: PRESSURIZE

STEP 3: RETRACT

FIGURE 6

| DESCRIPTION | ADVANCEMENT STEP 1500 | PRESSURIZATION STEP 1530 | RETRACTION STEP 1560 |
|---|---|---|---|
| 150A | OPEN | OPEN | CLOSED |
| 150B | CLOSED | CLOSED | OPEN |
| 150C | OPEN | OPEN | OPEN |
| 200A | CLOSED | CLOSED | OPEN |
| 200B | OPEN | OPEN | CLOSED |
| 200C | OPEN | OPEN | OPEN |
| 300 | CLOSED | OPEN | CLOSED |
| 350 | OPEN | CLOSED | OPEN |
| 400 | OPEN | CLOSED | OPEN |
| 450 | CLOSED | OPEN | CLOSED |
| First Ancillary Hydraulic Cylinder Rear Cylinder Space [146] | FLUID IN | FLUID IN | FLUID IN |
| First Ancillary Hydraulic Cylinder Front Cylinder Space [144] | FLUID OUT | FLUID IN | FLUID OUT |
| Primary Third Hydraulic Cylinder Rear Cylinder Space [194] | FLUID IN - ISOLATED FROM PRESSURE SOURCE | FLUID IN - COMMON WITH PRESSURE SOURCE | FLUID IN - ISOLATED FROM PRESSURE SOURCE |
| Primary Third Hydraulic Cylinder Front Cylinder Space [192] | FLUID IN - ISOLATED FROM PRESSURE SOURCE | FLUID IN - COMMON WITH PRESSURE SOURCE | FLUID IN - ISOLATED FROM PRESSURE SOURCE |
| Second Ancillary Hydraulic Cylinder Rear Cylinder Space [170] | FLUID IN | FLUID IN | FLUID OUT |
| Second Ancillary Hydraulic Cylinder Front Cylinder Space [168] | FLUID OUT | FLUID OUT | FLUID IN |
| STROKE POSITION | START AT L0 END AT L1 | START AT L1 END AT L2 | START AT L2 END AT L0 |

MASTER & SLAVE EMBODIMENT

HYDRAULIC FEEDER SYSTEM HAVING COMPRESSION STAGE WITH MULTI-CYLINDER HYDRAULIC CIRCUIT

RELATED APPLICATIONS

This is a continuation of U.S. patent application Ser. No. 14/775,071 filed 11 Sep. 2015, now U.S. Pat. No. 10,336,027, which is a 35 USC 371 U.S. National Phase of International Application No. PCT/US2013/035616, filed 8 Apr. 2013 and published in English as WO 2014/168604A1 on 16 Oct. 2014. The contents of the aforementioned applications are incorporated by reference in their entirety.

FIELD OF THE INVENTION

This invention relates to a system and method to improve the energy-efficiency of conventional carbonaceous feedstock plug feeder systems. More particularly, the present invention concerns an arrangement which permits a synchronous process for the advancement, pressurization, and retraction of a plurality of co-acting piston cylinder assemblies which together may be used to apply necessary forces for the creation of one or more plugs of compressible material for feeding into a reactor.

BACKGROUND

FIG. 1 shows a prior art feeding apparatus (02). Prior art feeding apparatus (02) comprises the following main components a first piston cylinder assembly (04), a second piston cylinder assembly (06), a third piston cylinder assembly (08), a first cylinder (10), a second cylinder (12), and a final, third cylinder (14), together with a plug disintegrator assembly (18), and a reactor feed screw assembly (22) to deliver the plugs to a reactor (104).

The first piston cylinder assembly (04) is comprised of: a first hydraulic cylinder (24), a first hydraulic cylinder front cylinder space (26), a first hydraulic cylinder rear cylinder space (28), a first hydraulic cylinder front connection port (30), a first hydraulic cylinder rear connection port (32), a first piston rod (34), a first hydraulic cylinder piston (36), a first hydraulic cylinder flange (38), and a first piston ram (40).

The first piston ram (40) is partly accommodated and arranged to travel in a reciprocating manner inside the first cylinder (10) which has associated therewith a feedstock inlet (42), a first cylinder first flange (44), and a first cylinder second flange (46). The first hydraulic cylinder flange (38) is connected to the first cylinder first flange (44).

The second piston cylinder assembly (06) is comprised of: second hydraulic cylinder (48), a second hydraulic cylinder front cylinder space (50), a second hydraulic cylinder rear cylinder space (52), a second hydraulic cylinder front connection port (54), a second hydraulic cylinder rear connection port (56), a second piston rod (58), a second hydraulic cylinder piston (60), a second hydraulic cylinder flange (62), and a second piston ram (64).

The second piston ram (64) is partly accommodated and arranged to travel in a reciprocating manner inside the second cylinder (12) which has associated with it a second cylinder first flange (66), a second cylinder second flange (68), a second cylinder third flange (70), and a cylindrical second pipe branch opening (72). The second hydraulic cylinder flange (62) is connected to the second cylinder first flange (66).

The first cylinder second flange (46) is connected to the second cylinder third flange (70) so as to allow a carbonaceous feedstock to be transferred through the first cylinder (10) by the advancing motion of the first piston ram (40) and partially compressed into the second cylinder (12) through the cylindrical second pipe branch opening (72).

The third piston cylinder assembly (08) is comprised of: third hydraulic cylinder (74), a third hydraulic cylinder front cylinder space (76), a third hydraulic cylinder rear cylinder space (78), a third hydraulic cylinder front connection port (80), a third hydraulic cylinder rear connection port (82), a third piston rod (84), a third hydraulic cylinder piston (86), a third hydraulic cylinder flange (88), and a third piston ram (90).

The third piston ram (90) is partly accommodated and arranged to travel in a reciprocating manner inside the final, third cylinder (14) which has associated with it a third cylinder first flange (92), a third cylinder second flange (94), a third cylinder third flange (96), and a cylindrical third pipe branch opening (98). The third hydraulic cylinder flange (88) is connected to the third cylinder first flange (92).

The second cylinder second flange (68) is connected to the third cylinder third flange (96) so as to allow a carbonaceous feedstock to be transferred through the second cylinder (12) by the advancing motion of the second piston ram (64) and partially compressed into the final, third cylinder (14) through the cylindrical third pipe branch opening (98).

After loose carbonaceous feedstock is transferred to the final, third cylinder (14) from the advancing motion of the second piston ram (64), the feedstock is then advanced through the final, third cylinder (14) by the advancing motion of the third piston ram (90) where it is compressed to develop a plug (100) of defined length and pressure to form the seal between the pressurized thermochemical reactor (104) and the feedstock inlet (42), which may be exposed to the atmosphere.

As seen in FIG. 1, the plug forms the primary seal between the pressurized thermochemical reactor (104) and the feedstock inlet (42). One of the three pistons is always in a closed position, which prevents a plug blow-out if the plug becomes unstable and provides additional safety against syngas leaks. Reference characters (L1) and (L2) indicate the stroke starting position (L1) and maximum stroke length position (L2), respectively, of terminal plug-forming end of the third piston ram (90). In a preferred configuration, the compressible material is pressed to form a plug with a pressure of 10-1000 bars by the advancing movement of the third piston ram (90).

As plugs are successively formed they are transferred to a plug disintegrator assembly (18) which breaks up the formed plug for transference into the fluidized bed (102) of the pressurized thermochemical reactor (104) via a reactor feed screw assembly (22).

U.S. Pat. No. 7,964,004 shows an assembly which includes three single-acting pistons for use in a system of the sort seen in FIG. 1.

SUMMARY OF THE INVENTION

In one aspect, the present invention is directed to a hydraulic circuit comprising:

a controller;

a primary hydraulic fluid source;

a platen configured to selectively move along a forward compression direction (310) and a rearward non-compression direction;

first and second ancillary piston cylinder assemblies, having respective first and second pistons operatively connected to the platen;

a third main piston cylinder assembly having a third piston operatively connected to the platen; and wherein:

in a first mode of operation, hydraulic fluid is introduced under pressure into the first and second ancillary piston cylinder assemblies, thereby causing the first and second pistons to urge the platen in the forward compression direction, while the third piston passively travels in the forward compression direction;

in a second mode of operation, hydraulic fluid is introduced under pressure into the first and second ancillary piston cylinder assemblies and also into the third main piston cylinder assembly, thereby causing the first, second and third pistons to collectively urge the platen in the forward compression direction; and in a third mode of operation, hydraulic fluid is introduced under pressure into at least the first and second ancillary piston cylinder assemblies, thereby causing at least the first and second pistons to urge the platen in the rearward non-compression direction In a second aspect, the present invention is directed to a feeder apparatus for advancing a compressible material, comprising:

a first piston cylinder assembly having a feedstock inlet suitable for receiving a compressible material;

a second piston cylinder assembly configured to receive material from the first piston cylinder assembly;

a third cylinder having a third cylinder ram arranged to travel therein, the third cylinder configured to receive material from the second piston cylinder assembly; and the hydraulic circuit according to claim 1; wherein:

the third cylinder ram is connected to the platen so as to travel therewith.

In a third aspect, the present invention is directed to a reactor comprising the aforementioned feeder apparatus, a plug disintegrator assembly and a reactor feed screw assembly, wherein: the third cylinder is connected to the reactor via the plug disintegrator assembly and the reactor feed screw assembly, to thereby provide a compressed plug of compressible material to the reactor.

BRIEF DESCRIPTION OF THE DRAWINGS

For a better understanding of the present invention and to show how the same may be carried out in practice, reference will now be made to the accompanying drawings, in which:

FIG. 6 presents a table of states of various circuit elements in the different operational modes of the hydraulic circuit.

DETAILED DESCRIPTION

Figure 1:
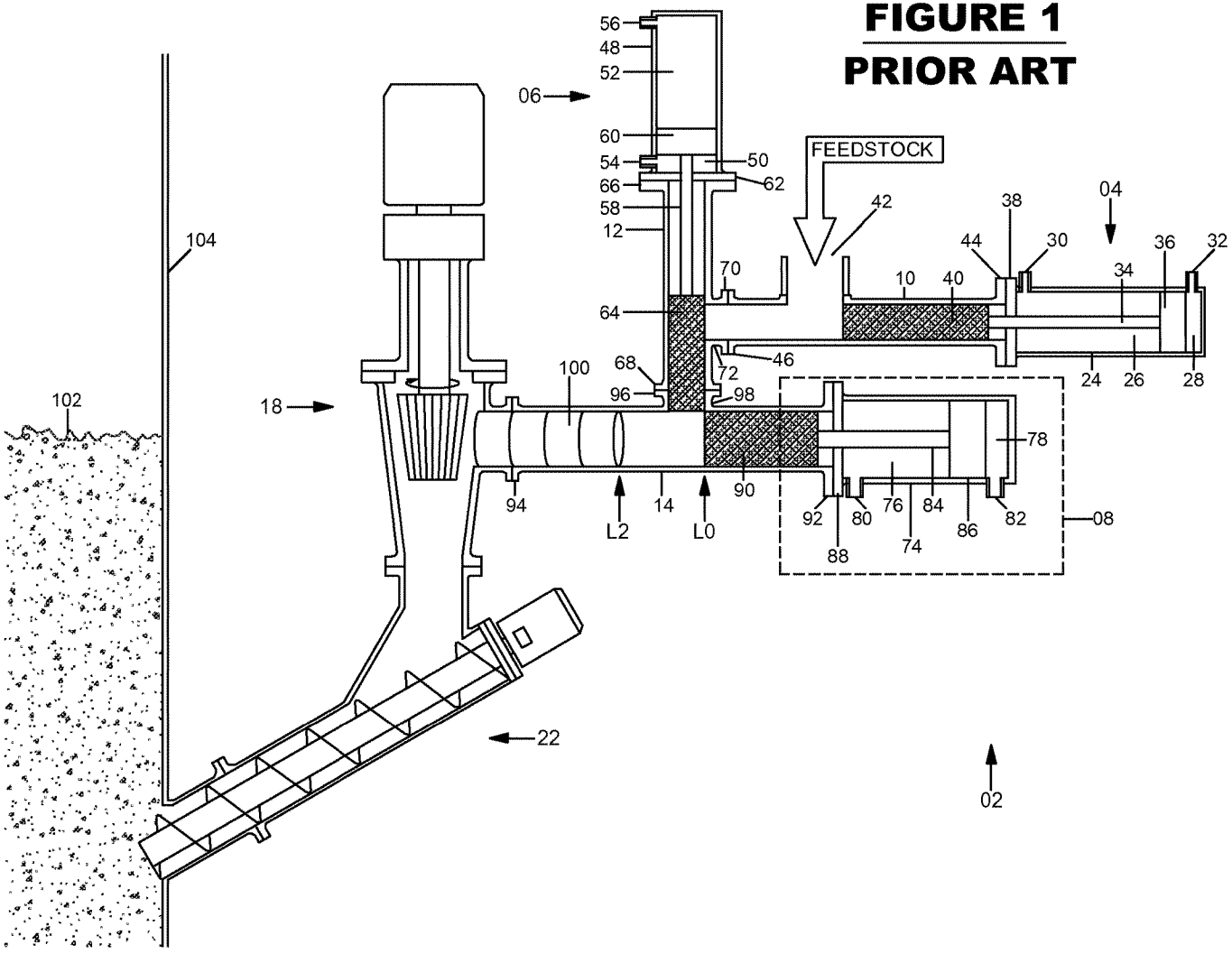
FIGURE 1 PRIOR ART
FIG. 1 is a diagrammatic representation of the prior art plug feeder system.
Figure 2:
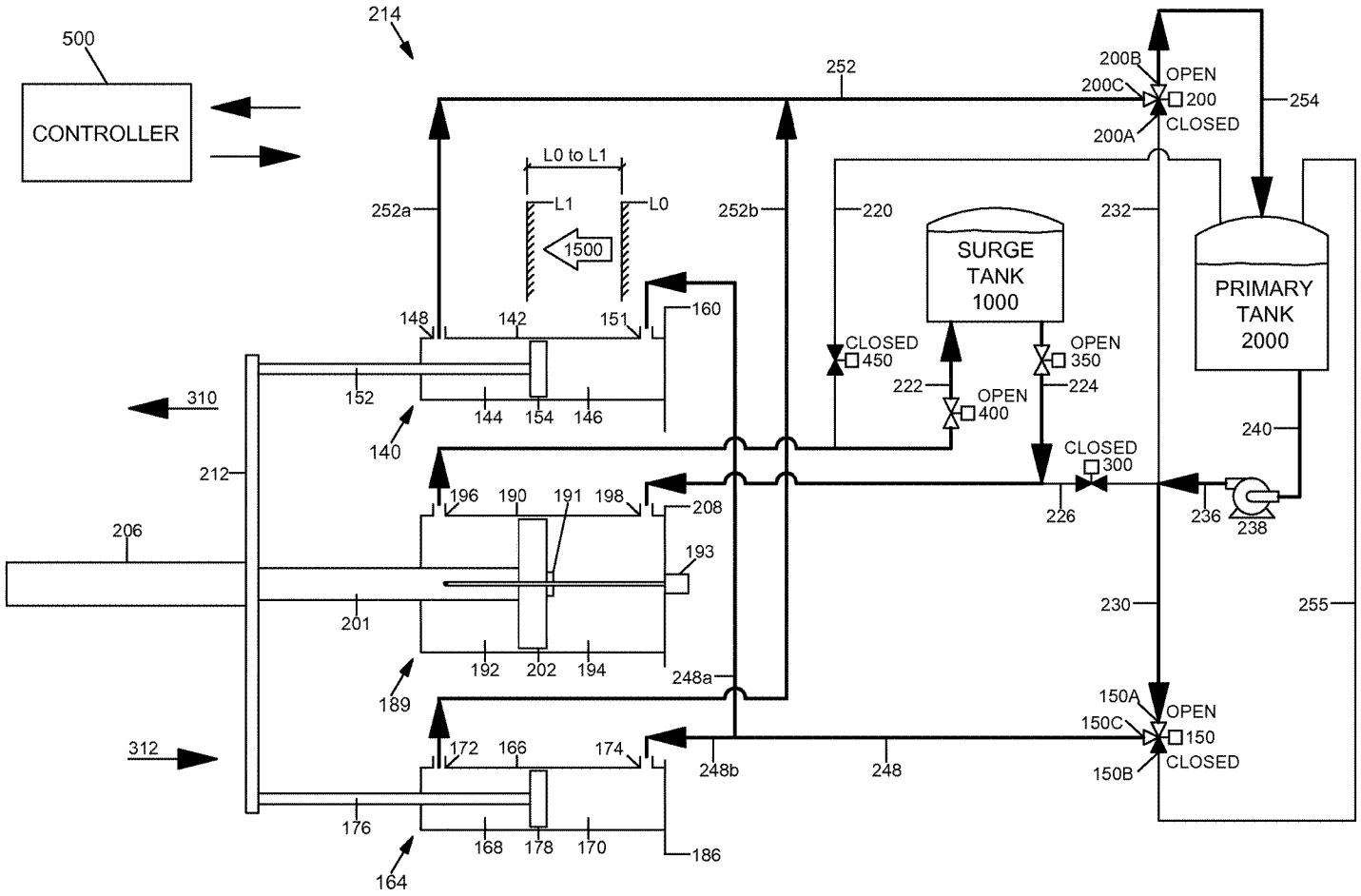
FIG. 2 illustrates an advancement stage of the hydraulic circuit of a system in accordance with one embodiment of the present invention.

FIG. 2 illustrates a preferred embodiment of the present invention wherein the third piston cylinder assembly (08) of the prior art is replaced by an inventive hydraulic compression circuit (214). The hydraulic compression circuit (214) includes the following: a first ancillary piston cylinder assembly (140), a second ancillary piston cylinder assembly (164), a primary third hydraulic cylinder assembly (189), a platen (212) driven by all three assemblies (140, 164 and 189), and a primary ram (206) coupled to the platen (212). The primary ram (206) can be considered to replace the prior art third piston ram (90) seen in FIG. 1. The first and second piston cylinder assemblies (140, 164) act in unison to advance or retract the platen (212) which in turn affects the advancement or retraction of the primary third hydraulic cylinder assembly (189) while also driving the primary ram (206), affixed to the opposing side of the platen (212), for the creation of one or more plugs of compressible material for feeding into a reactor (104).

The first ancillary piston cylinder assembly (140) is comprised of: a first ancillary hydraulic cylinder (142), a first ancillary hydraulic cylinder front cylinder space (144), a first ancillary hydraulic cylinder rear cylinder space (146), a first ancillary hydraulic cylinder front connection port (148), a first ancillary hydraulic cylinder rear connection port (151), a first ancillary hydraulic cylinder piston (154), and a first ancillary piston rod (152). The first ancillary piston rod (152) is connected to the platen (212).

Advancement and retraction of the piston (154) and rod (152) are with respect to the reference point created by the first ancillary hydraulic cylinder static end (160). The piston (154) defines ancillary front cylinder space (144) and ancillary rear cylinder space (146) in the first ancillary hydraulic cylinder (142). Each space contains hydraulic fluid.

The second ancillary piston cylinder assembly (164) is functionally identical to the first ancillary piston cylinder assembly (140) and is comprised of: a second ancillary hydraulic cylinder (166), a second ancillary hydraulic cylinder front cylinder space (168), a second ancillary hydraulic cylinder rear cylinder space (170), second ancillary hydraulic cylinder front connection port (172), a second ancillary hydraulic cylinder rear connection port (174), a second ancillary hydraulic cylinder piston (178), and a second ancillary piston rod (176). The second ancillary piston rod (176) is connected to the platen (212).

Advancement and retraction of the piston (178) and rod (176) are with respect to the reference point created by the second ancillary hydraulic cylinder static end (186). The piston (178) defines ancillary front cylinder space (168) and ancillary rear cylinder space (170) in the second ancillary hydraulic cylinder (166). Each space contains hydraulic fluid.

Piston rods (152) and (176) are connected to pistons (154) and (178), respectively, which are in sealing engagement with the walls of the cylinders (142) and (166), respectively. The system could be expanded to include any number of ancillary hydraulic cylinders, if such was required.

The primary third hydraulic cylinder assembly (189) is comprised of: a primary third hydraulic cylinder (190), a primary third hydraulic cylinder front cylinder space (192), a primary third hydraulic cylinder rear cylinder space (194), a primary third hydraulic cylinder front connection port (196), a primary third hydraulic cylinder rear connection port (198), a primary third hydraulic cylinder piston (202), and a primary third piston rod (201). The primary third piston rod (201) is connected to the platen (212).

The primary third piston rod (201) is connected to the primary third hydraulic cylinder piston (202) which is in sealing engagement with the walls of the primary third hydraulic cylinder (190). The piston (202) defines the front cylinder space (192) and the rear cylinder space (194) in the third cylinder (190). Each space contains hydraulic fluid.

At least one of the cylinders has a sensor that provides feedback signal to a distributed control system (DCS), programmable logic controller (PLC), or motion controller transmitting or indicating the exact position of the associated piston along its entire linear stroke (from start position, L0, to end the position, L2).

The sensor outputs a signal reflective of a position of third piston (202). This may be done by measuring the position of the primary ram (206), the position of the platen (212), the position of any of the piston rods (152, 176, 201), or the positions of any of the pistons (154, 178, 202). It is understood that measuring any one of these can provide information about the position of any of the others, since the primary ram, the platen, the piston rods and the pistons all move together.

In a preferred embodiment, the sensor comprises a linear transducer (193) having a first end attached to a fixed (non-moving) portion of one of the hydraulic cylinder assemblies (140, 164, 189) and a second end attached to a movable portion of said one of the hydraulic cylinder assemblies (140, 164, 189), or to the platen (212) or the primary ram (206). In a preferred embodiment, the linear transducer (193) is attached to the primary third hydraulic cylinder static end (208). The linear transducer (193) protrudes through the primary third hydraulic cylinder rear cylinder space (194) to be accommodated within an opening (191) deliberately 'gun-drilled' in the primary third piston rod (201) and primary third hydraulic cylinder piston (202), to precisely control and monitor the movement of the platen (212) and primary ram (206).

In an alternate embodiment, the sensor that is used for sensing and indication of the stroke position of the primary third piston rod (201), that is, indicating the amount of extension or the position of the piston rod (201) from a reference may be installed exterior to the hydraulic cylinder (142) (not shown) so it can be installed and removed without disassembly of the cylinder. In either embodiment, the single output by the linear transducer (193) reflects the position of third piston (202).

The hydraulic compression circuit (214) as depicted in FIG. 2 also includes: a primary tank (2000), a surge tank (1000), a hydraulic pump (238), and a plurality of valves. The plurality of valves includes an ancillary cylinder rear valve (150), an ancillary cylinder front valve (200), a primary third cylinder rear supply valve (300), a primary third cylinder rear surge valve (350), a primary third cylinder front surge valve (400), and a primary third cylinder front drain valve (450).

The ancillary cylinder rear valve (150) includes an ancillary cylinder rear supply port (150A), an ancillary cylinder rear drain port (150B), and an ancillary cylinder rear common port (150C).

The ancillary cylinder front valve (200) includes an ancillary cylinder front supply port (200A), an ancillary cylinder front drain port (200B), and an ancillary cylinder front common port (200C).

A pump suction line (240) connects the primary tank (2000) with the hydraulic pump (238). A pump discharge line (236) connects the outlet of the hydraulic pump (238) with: the ancillary cylinder front supply port (200A) through the ancillary cylinder front supply line (232); the ancillary cylinder rear supply port (150A) through the ancillary cylinder rear supply line (230); and the primary third cylinder rear supply valve (300) through the primary third cylinder rear supply line (226). The hydraulic pump (238) may provide pressurized fluid to any of these three valves through their respective transfer lines.

The primary third hydraulic cylinder rear connection port (198) is in communication with the primary third cylinder rear supply line (226) where the open or closed position of the primary third cylinder rear supply valve (300) restricts the availability of the pressurized fluid transferred from the discharge of the hydraulic pump (238) to the primary third hydraulic cylinder rear cylinder space (194).

The primary third hydraulic cylinder rear connection port (198) is also in communication with the surge tank (1000) via a primary third cylinder rear surge line (224) with the primary third cylinder rear surge valve (350) interposed therebetween.

The primary third hydraulic cylinder front connection port (196) is in communication with the surge tank (1000) via a primary third cylinder front surge line (222) with the primary third cylinder front surge valve (400) interposed therebetween.

The primary third hydraulic cylinder front connection port (196) is also in communication with the primary tank (2000) via a primary third cylinder front drain line (220) with the primary third cylinder front drain valve (450) interposed therebetween.

Ancillary front cylinder space drain lines (252*a*, 252*b*) connect both the first ancillary hydraulic cylinder front connection port (148), and the second ancillary hydraulic cylinder front connection port (172), respectively, with the ancillary cylinder front common port (200C) of the ancillary cylinder front valve (200), via the shared ancillary front cylinder space drain line (252).

Ancillary rear cylinder space drain lines (248*a*, 248*b*) connect both the first ancillary hydraulic cylinder rear connection port (151), and the second ancillary hydraulic cylinder rear connection port (174), respectively, with the ancillary cylinder rear common port (150C) of the ancillary cylinder rear valve (150), via the shared ancillary rear cylinder space drain line (248).

As seen in the arrangement of FIG. 2, although they share the ancillary cylinder drain lines (248, 252), the two ancillary cylinders (142, 166) are coupled in hydraulic parallel with the primary tank (2000) in the sense that the hydraulic fluid is not configured to flow between the first and second ancillary piston cylinders (142, 166).

The ancillary cylinder front drain port (200B) of the ancillary cylinder front valve (200) is connected to the primary tank (2000) through an ancillary front cylinder space drain line (254).

The ancillary cylinder rear drain port (150B) of the ancillary cylinder rear valve (150) is connected to the primary tank (2000) through an ancillary rear cylinder space drain line (255).

Figure 3:
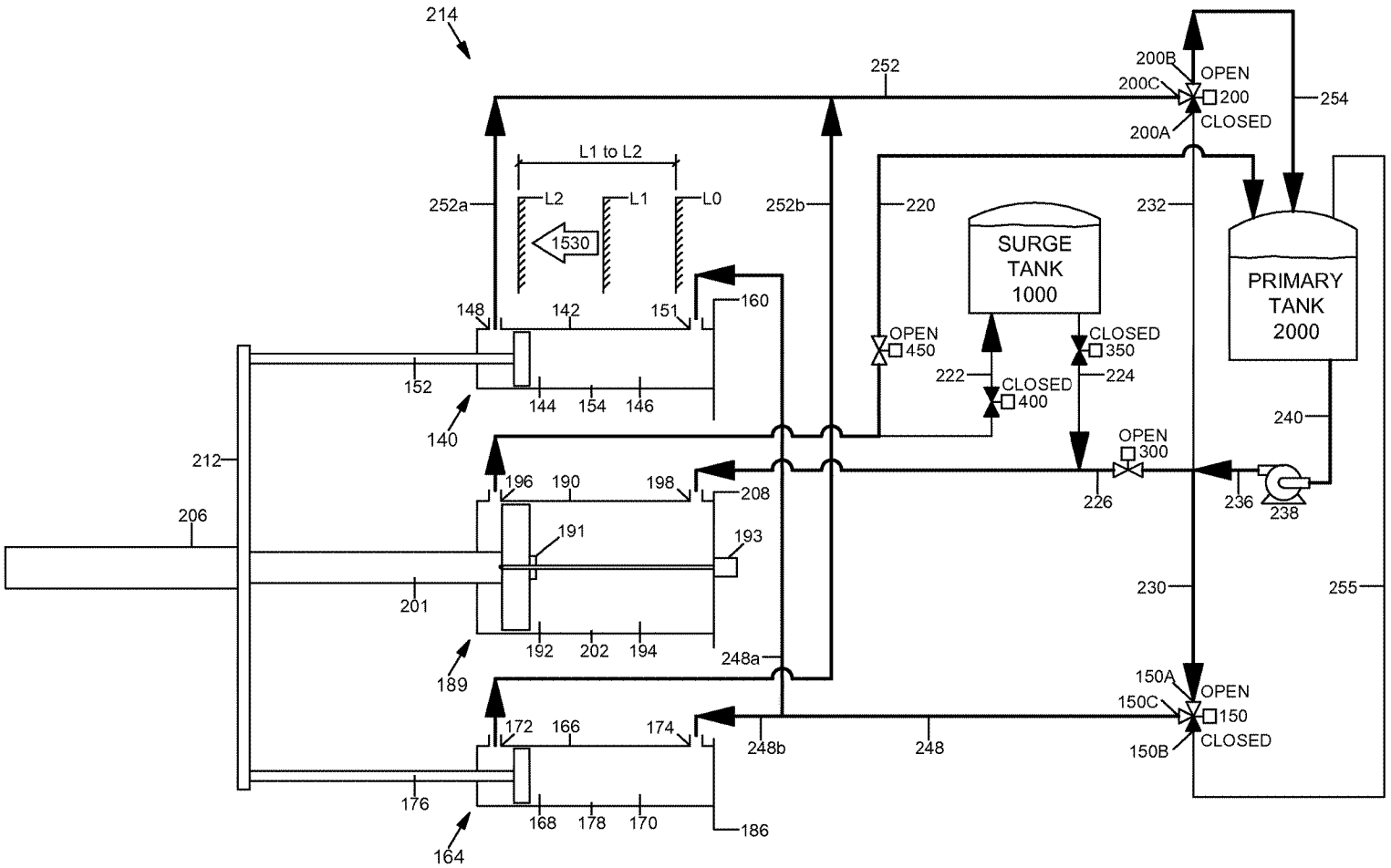
FIG. 3 illustrates a pressurization stage of the hydraulic circuit of a system in accordance with one embodiment of the present invention.
Figure 4:
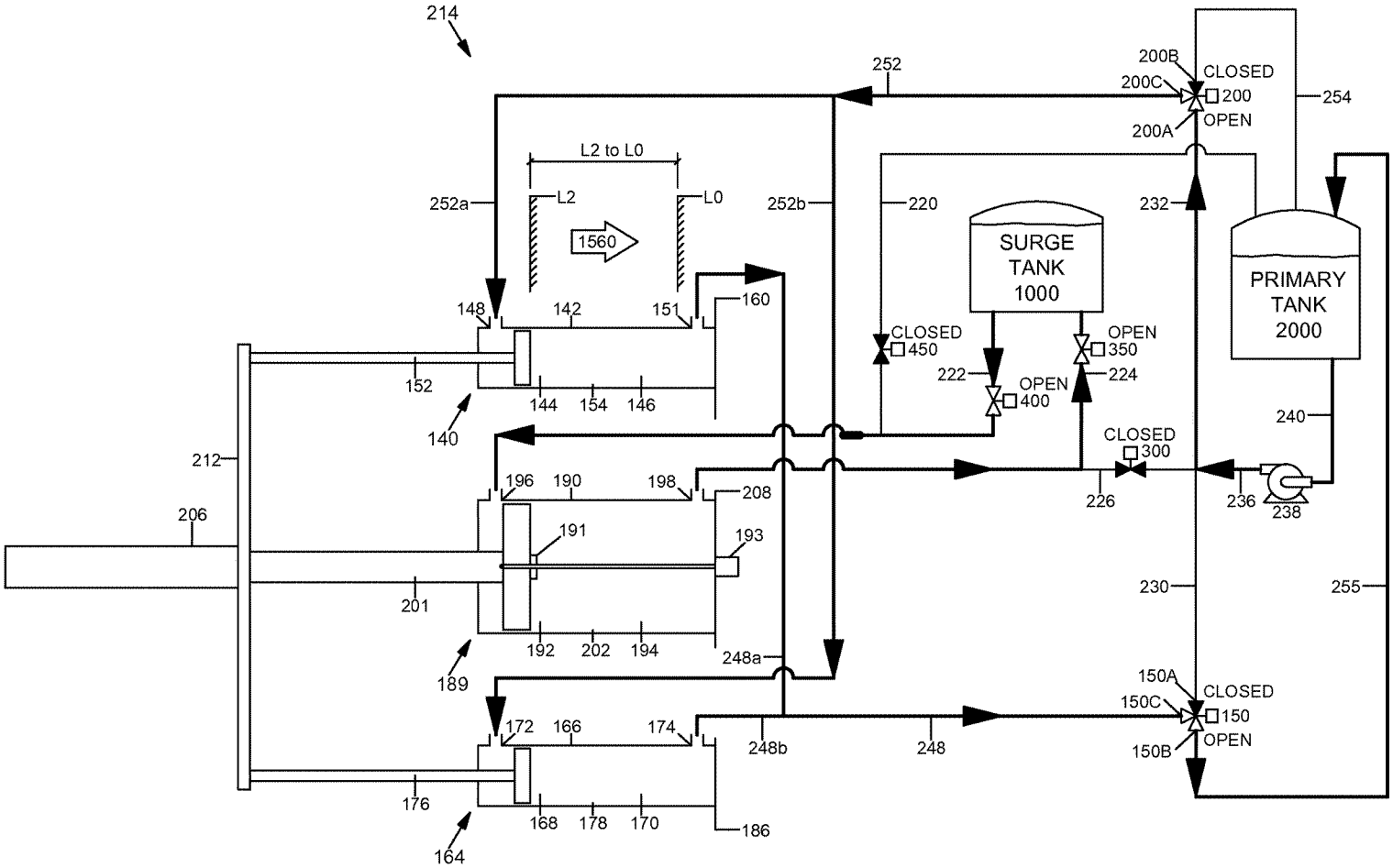
FIG. 4 illustrates a retraction stage of the hydraulic circuit of a system in accordance with one embodiment of the present invention.
Figure 5:
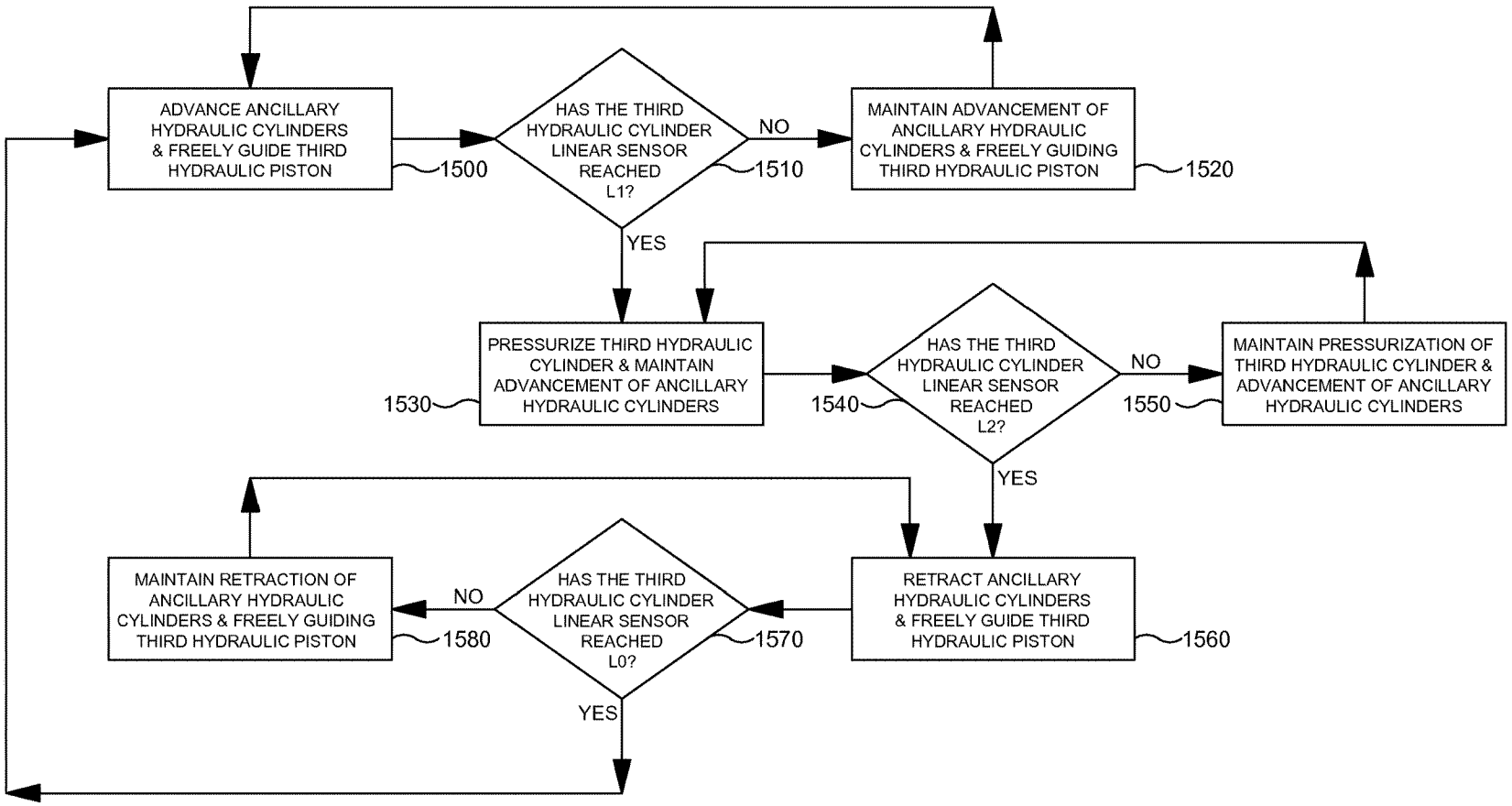
FIG. 5 presents a flow chart for controlling the advancement, pressurization, and retraction of the energy-efficient hydraulic compression plug formation process.

FIGS. 2, 3 and 4, in conjunction with FIGS. 5 and 6, describe the various modes (steps) of operation of the hydraulic circuit (214). FIG. 5 shows a Flow Chart and FIG. 6 shows a Detailed Sequencing Chart, which together depict the valve sequencing, sequence mode/step characteristics, and overall approach of the inventive method. It is understood that the bold arrows in each of FIGS. 2, 3 and 4 indicated open flow paths for the hydraulic fluid, as determined by positions of the various valves.

Advancement Sequence Mode (1500)

FIG. 2 shows the hydraulic compression circuit (214) in the advancement sequence mode/step. In the advancement sequence mode (1500), advancement of the first ancillary piston cylinder assembly (140) and the second ancillary piston cylinder assembly (164) take place while the primary third hydraulic cylinder assembly (189) is isolated from the hydraulic pump (238).

Isolating the primary third hydraulic cylinder rear cylinder space (194) from the hydraulic pump (238) during the advancement sequence step (1500) has certain advantages related to the energy efficiency of the prior art feeding apparatus (02).

A high power consumption and unfavorable energy efficiency is associated with the third hydraulic cylinder (74) of the prior art feeding apparatus (02) since it is the largest of the three hydraulic cylinder assemblies and requires the most volume of hydraulic fluid for driving its piston.

The diameters of the first ancillary piston cylinder assembly (140) and the second ancillary piston cylinder assembly (164), specifically the pressure-receiving surface area of each of their pistons (154, 176) are of a lesser diameter than that of the primary third hydraulic cylinder piston (202).

Utilization of a platen (212) and two or more ancillary piston cylinder assemblies (140, 164) with diameters smaller than that of the primary third hydraulic cylinder assembly (189) reduces the volume of fluid required to advance the primary ram (206). This results in a more economical process for the compression of carbonaceous material into a plug of desired length and density.

In the advancement sequence mode (1500), hydraulic fluid is drawn from the primary tank (2000) and transferred through ancillary cylinder rear supply line (230), ports (150A, 150C) of ancillary cylinder rear valve (150), and ancillary rear cylinder space drain lines (248, 248*a*, 248*b*) into ancillary rear cylinder spaces (146, 170) of the first ancillary piston cylinder assembly (140) and second ancillary piston cylinder assembly (164).

Also in the advancement sequence step (1500), hydraulic fluid is displaced from the ancillary front cylinder spaces (144, 168) of the first ancillary piston cylinder assembly (140) and second ancillary piston cylinder assembly (164) and is returned to the primary tank (2000) through ancillary front cylinder space drain lines (252, 252*a*, 252*b*), ports (200C, 200B) of ancillary cylinder front valve (200) and ancillary front cylinder space drain line (254).

The hydraulic fluid advances ancillary pistons (154, 178) which in turn advances the motion of the platen (212) and primary ram (206) while also advancing the motion of the primary third piston rod (201) and primary third hydraulic cylinder piston (202).

Additionally, in the advancement sequence step (1500), the primary cylinder front and rear supply valves (300, 450) are closed, while the primary cylinder front and rear surge valves (350, 450) are open. This allow the primary third piston rod (201) and the primary third hydraulic cylinder piston (202) to advance while the primary third hydraulic cylinder front cylinder space (192) and primary third hydraulic cylinder rear cylinder space (194) are isolated from the discharge pressure of the hydraulic pump (238).

Hydraulic fluid displaced from the primary third hydraulic cylinder front cylinder space (192) is allowed to freely flow into the surge tank (1000) through primary third cylinder front surge line (222) and open front surge valve (400). In a similar vein, hydraulic fluid from the surge tank (1000) is allowed to freely flow into the primary third hydraulic cylinder rear cylinder space (194) through the primary third cylinder rear surge line (224) and open rear surge valve (350). Thus, by virtue of connection to the platen (212), the primary third piston rod (201) and the primary third hydraulic cylinder piston (202) go along for the ride, as the hydraulic fluid advances the ancillary pistons (154, 178).

Hydraulic fluid continues to be transferred to the ancillary rear cylinder spaces (146, 170) of the first ancillary piston cylinder assembly (140) and second ancillary piston cylinder assembly (164) until the linear transducer (193) indicates that a first predetermined set-point of the intermediate stroke length position (L1) has been reached. The output of the linear transducer (193) is provided to a controller (500). In response to the output from the linear transducer (193) indicating that the first predetermined set-point has been reached, the controller (500) is configured to control the various valves such that the system transitions from the advancement sequence mode (1500) to the pressurization sequence mode (1530).

Pressurization Sequence Mode (1530)

FIG. 3 shows the hydraulic compression circuit (214) in the pressurization sequence mode/step (1530). In contrast to the advancement sequence mode, in the pressurization sequence mode, the primary cylinder front and rear supply valves (300, 450) are open, while the primary cylinder front and rear surge valves (350, 450) are closed. This isolates the primary third cylinder assembly (189) from the surge tank (1000) and allows hydraulic fluid to flow from (a) the primary tank (2000) to the primary third hydraulic cylinder rear cylinder space (194) and, from (b) the primary third hydraulic cylinder front cylinder space (192) to the primary tank (2000). As such, the primary third hydraulic cylinder rear cylinder space (194) is available to the pressurized discharge of the hydraulic pump (238), in addition to the ancillary rear cylinder spaces (146, 170) of the first ancillary piston cylinder assembly (140) and second ancillary piston cylinder assembly (164). In another embodiment the surge tank (1000) may not be used but one common tank, such as the primary tank (2000), may be used as the sole storage reservoir and surge tank for the hydraulic compression circuit (214), given appropriate valve placement and control.

In the pressurization sequence mode (1530), hydraulic fluid is transferred to all the rear cylinder spaces (146, 170, 194) of the ancillary and primary piston cylinder assemblies (140, 164, 189) until the linear transducer (193) indicates that a second predetermined set-point of the maximum stroke length position (L2) has been reached. The output of the linear transducer (193) is provided to the aforementioned controller (500). In response to the output from the linear transducer (193) indicating that the second predetermined set-point has been reached, the controller (500) is configured to control the various valves such that the system transitions from the pressurization sequence mode (1530) to the retraction sequence mode (1560).

Retraction Sequence Mode (1560)

FIG. 4 represents the valve sequencing and flow path of hydraulic fluid in the retraction sequence mode (1560).

In the retraction sequence mode (1560), the primary cylinder front and rear supply valves (300, 450) are closed, and the primary cylinder front and rear surge valves (350, 400) are open, much like in the advancement sequence mode (1500). However, relative to their corresponding positions in the advancement sequence mode (1500), in the retraction sequence mode (1560), the positions of ancillary supply ports (150A, 200A) and the positions ancillary drain ports (150B, 200B) of the ancillary cylinder valves (150, 200) are reversed.

Hydraulic fluid is transferred from the hydraulic pump (238) through ancillary cylinder front supply line (232) and ports (200A, 200C) of ancillary cylinder front valve (200) into the ancillary front cylinder spaces (144, 168) of the first ancillary piston cylinder assembly (140) and second ancillary piston cylinder assembly (164).

Hydraulic fluid displaced from the primary third hydraulic cylinder rear cylinder space (194) is allowed to freely flow into the surge tank (1000) through rear surge line (224) and open rear surge valve (350). Accordingly, hydraulic fluid from the surge tank (1000) is allowed to freely flow into the primary third hydraulic cylinder front cylinder space (192) through front surge line (222) and open front surge valve (400).

Hydraulic fluid displaced from the ancillary rear cylinder spaces (146, 170) of the first ancillary piston cylinder assembly (140) and second ancillary piston cylinder assembly (164) is diverted back to the primary tank (2000) through ancillary cylinder rear drain lines (248, 248*a*, 248*b*), ports 150C and 150B of ancillary cylinder rear valve (150), and ancillary rear cylinder space drain line (255).

Hydraulic fluid entering the ancillary front cylinder spaces (144, 168) causes the first and second ancillary hydraulic cylinder pistons (154) and (178) to retract, thus pulling the platen (212). Due to motion of the platen (212), the primary ram (206), the primary third piston rod (201) and the primary third hydraulic cylinder piston (202) freely retract as well.

Hydraulic fluid is transferred to the ancillary front cylinder spaces (144,168) of the first ancillary piston cylinder assembly (140) and second ancillary piston cylinder assembly (164), thereby causing retraction of the primary third piston cylinder assembly (189), until the linear sensor transducer (193) indicates a predetermined third set-point of the stroke starting position (L0) has been reached. The output of the linear transducer (193) is provided to the aforementioned controller (500). In response to the output from the linear transducer (193) indicating that the third predetermined set-point has been reached, the controller (500) may be configured to control the various valves such that the system transitions from the retraction sequence mode (1560) to the advancement sequence mode (1500), to repeat the compression process.

Figure 7:
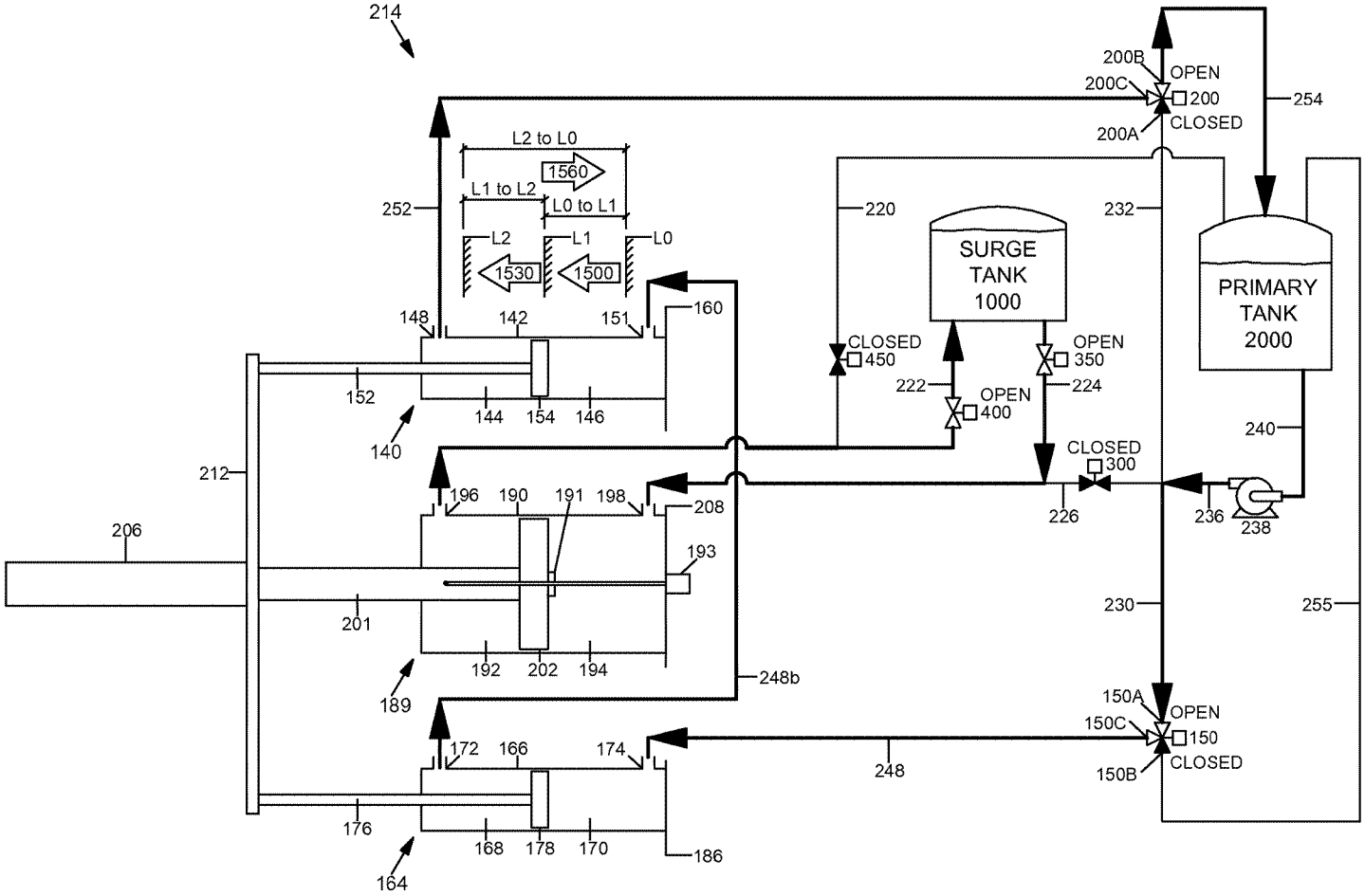
FIG. 7 illustrates a schematic view of a second embodiment of a hydraulic circuit in which the ancillary cylinders assemblies are in a master-slave arrangement.

FIG. 7 shows an alternate embodiment in which the ancillary cylinders (142, 166) are in a master-slave arrangement. In the master-slave arrangement, hydraulic fluid flows from the front cylinder space of a first ancillary cylinder to the rear cylinder space of a second ancillary cylinder. In this sense, the two ancillary cylinders (142, 166) are coupled in hydraulic series, with the hydraulic fluid configured to flow between the first and second ancillary piston cylinders (142 166).

Although the present invention has been described with reference to certain embodiments, it should be understood that various alterations and modifications could be made without departing from the spirit or scope of the invention as hereinafter claimed.

TABLE OF REFERENCE NUMERALS stroke starting position (L0)
intermediate stroke length position (L1)
maximum stroke length position (L2)
feeding apparatus (02)
first piston cylinder assembly (04)
second piston cylinder assembly (06)
third piston cylinder assembly (08)
first cylinder (10)
second cylinder (12)
third cylinder (14)
plug disintegrator assembly (18)
reactor feed screw assembly (22)
first hydraulic cylinder (24)
first hydraulic cylinder front cylinder space (26)
first hydraulic cylinder rear cylinder space (28)
first hydraulic cylinder front connection port (30)
first hydraulic cylinder rear connection port (32)
first piston rod (34)
first hydraulic cylinder piston (36)
first hydraulic cylinder flange (38)
first piston ram (40)
inlet means (42)
first cylinder first flange (44)
first cylinder second flange (46)
second hydraulic cylinder (48)
second hydraulic cylinder front cylinder space (50)
second hydraulic cylinder rear cylinder space (52)
second hydraulic cylinder front connection port (54)
second hydraulic cylinder rear connection port (56)
second piston rod (58)
second hydraulic cylinder piston (60)
second hydraulic cylinder flange (62)
second piston ram (64)
second cylinder first flange (66)
second cylinder second flange (68)
second cylinder third flange (70)
second cylindrical pipe branch opening (72)
third hydraulic cylinder (74)
third hydraulic cylinder front cylinder space (76)
third hydraulic cylinder rear cylinder space (78)
third hydraulic cylinder front connection port (80)
third hydraulic cylinder rear connection port (82)
third piston rod (84)
third hydraulic cylinder piston (86)
third hydraulic cylinder flange (88)
third piston ram (90)
third cylinder first flange (92)
third cylinder second flange (94)
third cylinder third flange (96)
third cylindrical pipe branch opening (98)
plug (100)
fluidized bed (102)
reactor (104)
first ancillary piston cylinder assembly (140)
first ancillary hydraulic cylinder (142)
first ancillary hydraulic cylinder front cylinder space (144)
first ancillary hydraulic cylinder rear cylinder space (146)
first ancillary hydraulic cylinder front connection port (148)
ancillary cylinder rear valve (150)
ancillary cylinder rear supply port (150A)
ancillary cylinder rear drain port (150B)
ancillary cylinder rear common port (150C)
first ancillary hydraulic cylinder rear connection port (151)
first ancillary piston rod (152)
first ancillary hydraulic cylinder piston (154)
first ancillary hydraulic cylinder static end (160)
second ancillary piston cylinder assembly (164)
second ancillary hydraulic cylinder (166)
second ancillary hydraulic cylinder front cylinder space (168)
second ancillary hydraulic cylinder rear cylinder space (170)

second ancillary hydraulic cylinder front connection port (172)
second ancillary hydraulic cylinder rear connection port (174)
second ancillary piston rod (176)
second ancillary hydraulic cylinder piston (178)
second ancillary hydraulic cylinder static end (186)
primary third hydraulic cylinder assembly (189)
primary third hydraulic cylinder (190)
opening (191)
primary third hydraulic cylinder front cylinder space (192)
linear transducer (193)
primary third hydraulic cylinder rear cylinder space (194)
primary third hydraulic cylinder front connection port (196)
primary third hydraulic cylinder rear connection port (198)
ancillary cylinder front valve (200)
ancillary cylinder front supply port (200A)
ancillary cylinder front drain port (200B)
ancillary cylinder front common port (200C)
primary third piston rod (201)
primary third hydraulic cylinder piston (202)
primary ram (206)
primary third hydraulic cylinder static end (208)
platen (212)
hydraulic compression circuit (214)
primary third cylinder front drain line (220)
primary third cylinder front surge line (222)
primary third cylinder rear surge line (224)
primary third cylinder rear supply line (226)
ancillary cylinder rear supply line (230)
ancillary cylinder front supply line (232)
pump discharge line (236)
hydraulic pump (238)
pump suction line (240)
shared ancillary rear cylinder space drain line (248)
ancillary rear cylinder space drain line (248*a*)
ancillary rear cylinder space drain line (248*b*)
shared ancillary front cylinder space drain line (252)
ancillary front cylinder space drain line (252*a*)
ancillary front cylinder space drain line (252*b*)
ancillary front cylinder space drain line (254)
ancillary rear cylinder space drain line (255)
primary third cylinder rear supply valve (300)
forward compression direction (310)
rearward non-compression direction (312)
primary third cylinder rear surge valve (350)
primary third cylinder front surge valve (400)
primary third cylinder front drain valve (450)
controller (500)
surge tank (1000)
primary tank (2000)
advancement sequence step 1500
pressurization sequence step 1530
retraction sequence step 1560

What is claimed is:

1. A hydraulic feeder system for advancing a compressible material, comprising:

a controller;

a primary hydraulic fluid source;

a multi-cylinder assembly comprising:

at least one ancillary piston cylinder assembly having an ancillary hydraulic cylinder with an ancillary piston connected to an ancillary piston rod, said ancillary piston dividing the ancillary hydraulic cylinder into an ancillary front cylinder space having an ancillary front connection port, and an ancillary rear cylinder space having an ancillary rear connection port;

a main piston cylinder assembly having a primary hydraulic cylinder with a primary piston connected to a primary piston rod, said primary piston dividing the primary hydraulic cylinder into a primary front cylinder space, and a primary rear cylinder space having a primary rear connection port;

a surge tank selectively in fluid communication with at least the primary rear connection port of the main piston cylinder assembly;

a primary piston ram operatively connected to the primary piston rod and configured to travel in a reciprocating manner inside a primary cylinder; and a feedstock inlet connected to the primary cylinder;

wherein:

the ancillary piston has a smaller surface area than the primary piston;

the ancillary piston cylinder assembly is operatively coupled to the main piston cylinder assembly such that the ancillary piston and the primary piston move together; and the controller is configured to selectively operate the system in a plurality of modes of operation, the modes of operation including at least:

a first mode of operation in which hydraulic fluid is introduced under pressure from the primary hydraulic fluid source into the ancillary rear cylinder space via the ancillary rear connection port but not into the primary rear cylinder space via the primary rear connection port, thereby causing the ancillary piston to travel in a forward compression direction, while the primary piston passively travels in the same forward compression direction, the surge tank being in fluid communication with the primary rear connection port to permit the primary piston to passively travel in the forward compression direction;

a second mode of operation in which hydraulic fluid is introduced under pressure from the primary hydraulic fluid source into both the ancillary rear cylinder space via the ancillary rear connection port and the primary rear cylinder space via the primary rear connection port, thereby causing both the ancillary and primary pistons to simultaneously travel in the same forward compression direction, the surge tank not being in fluid communication with the primary rear connection port; and a third mode of operation in which hydraulic fluid is introduced under pressure from the primary hydraulic fluid source into the ancillary front cylinder space, thereby causing the ancillary piston to travel in a rearward non-compression direction, while the primary piston passively travels in the same rearward non-compression direction, the surge tank being in fluid communication with the primary rear connection port to permit the primary piston to passively travel in the rearward non-compression direction.

2. The hydraulic feeder system according to claim 1, further comprising:

a second piston cylinder assembly having a second hydraulic cylinder with a second piston having a second piston rod connected to a second piston ram, the second piston ram configured to travel in a reciprocating manner inside a second cylinder which connects to the primary cylinder at a branch opening; wherein:

the feedstock inlet is connected to the primary cylinder via the second cylinder.

3. The hydraulic feeder system according to claim 1, further comprising:

a plug disintegrator assembly configured to break up a plug of compressed feedstock formed in the primary piston.

4. The hydraulic feeder system according to claim 3, further comprising:

a feed screw assembly positioned to receive broken-up compressed feedstock from the plug disintegrator assembly and transfer the broken-up compressed feedstock in a direction away from the plug disintegrator assembly for further processing.

5. The hydraulic feeder system according to claim 4, further comprising:

a thermochemical reactor connected to the feed screw assembly; wherein:

the feed screw assembly is configured to transfer said broken-up portions of compressed feedstock into the thermochemical reactor.

6. The hydraulic feeder system according to claim 5, wherein:

the thermochemical reactor is a fluidized bed reactor, which is pressurized; and compressed feedstock within the primary cylinder forms a pressure seal between the thermochemical reactor and the feedstock inlet.

7. The hydraulic feeder system according to claim 1, wherein:

the ancillary piston rod and the primary piston rod are parallel to one another.

8. The hydraulic feeder system according to claim 1, further comprising:

a sensor (193) configured to output a signal reflective of a position of the primary piston (202); wherein:

the controller (500) is configured to receive the signal from the sensor (193) and, in response thereto, cause the system to transition between modes of operation.

9. The hydraulic feeder system according to claim 8, wherein:

the ancillary piston rod and the primary piston rod are non-coaxial and connected by a common platen to the primary piston ram.

10. The hydraulic feeder system according to claim 9, wherein:

the controller is configured to transition the system from the first mode of operation to the second mode of operation, when the signal indicates that the primary piston has reached a first predetermined position which is between its travel extremes.

11. The hydraulic feeder system according to claim 9, wherein:

the sensor comprises a linear transducer having a first end attached to a fixed portion of one of the ancillary and main piston cylinder assemblies and a second end attached to a movable portion of one of the ancillary and main piston cylinder assemblies.

12. The hydraulic feeder system according to claim 1, wherein:

the multi-cylinder assembly comprises identical first and second ancillary piston cylinder assemblies which move together in all three modes of operation; and the first and second ancillary piston cylinder assemblies are connected in parallel with the primary hydraulic fluid source.

13. The hydraulic feeder system according to claim 1, wherein:

the multi-cylinder assembly comprises identical first and second ancillary piston cylinder assemblies which move together in all three modes of operation; and the first and second ancillary piston cylinder assemblies are connected in series with the primary hydraulic fluid source.

14. A method of compressing a feedstock in a hydraulic feeder system, the hydraulic feeder system comprising:

a multi-cylinder assembly including an ancillary piston cylinder assembly having an ancillary piston and a main piston cylinder assembly having a primary piston operatively connected to a primary ram occupying a primary cylinder, wherein the ancillary piston has a smaller cross-sectional area than the primary piston and the ancillary and primary pistons are connected so that they move together;

a surge tank selectively in fluid communication with a connection port of the main piston cylinder assembly; and a feedstock inlet connected to the primary cylinder;

the method comprising:

introducing feedstock into the hydraulic feeder system via the feedstock inlet;

transferring feedstock from the feedstock inlet into the primary cylinder;

in a first mode of operation, introducing hydraulic fluid under pressure into the ancillary piston cylinder assembly and not into the main piston cylinder assembly, so as to cause the ancillary piston to travel in a forward compression direction until reaching a first predetermined position, the primary piston traveling passively along with the ancillary piston in said forward compression direction with the primary ram propelling at least a portion of said feedstock material in said forward compression direction, the surge tank being in fluid communication with said connection port in said first mode of operation;

in a second mode of operation, introducing hydraulic fluid under pressure into both the ancillary piston cylinder assembly and the main piston cylinder assembly so as to cause both the ancillary piston and the primary piston to simultaneously travel in said forward compression direction until reaching a second predetermined position with the primary ram compressing said a portion of said feedstock to form a plug, the surge tank not being in fluid communication with the connection port in said second mode of operation; and in a third mode of operation, introducing hydraulic fluid under pressure into the ancillary piston cylinder assembly, so as to cause the ancillary piston to travel in a rearward non-compression direction until reaching a third predetermined position, the primary piston traveling passively along with the ancillary piston in said rearward non-compression direction, along with said primary ram, the surge tank being in fluid communication with the connection port in said third mode of operation.

15. The method of compressing a feedstock according to claim 14, wherein:

the hydraulic feeder system further comprises a second piston cylinder assembly having a second piston ram occupying a second cylinder which connects to the primary cylinder at a primary branch opening;

the feedstock inlet is connected to the primary cylinder via the second cylinder; and the method further comprises transferring the feedstock into the primary cylinder from the second cylinder with the second piston ram.

16. The method of compressing a feedstock according to claim 14, comprising:

in the second mode of operation, introducing hydraulic fluid under pressure into both the primary piston assembly and the ancillary piston cylinder assembly, compressing said a portion of said feedstock with a pressure of 10-1000 bars to form the plug.

17. The method of operating a hydraulic feeder system according to claim 14, further comprising:

breaking up the plug; and transferring the broken up plug in a direction away from the hydraulic feeder system for further processing.

18. A method of feeding a carbonaceous feedstock into a pressurized thermochemical reactor, comprising:

(a) successively forming a plurality of plugs of carbonaceous material in the primary cylinder by compressing carbonaceous feedstock in accordance with the method of claim 15 a corresponding plurality of times, the plurality of plugs forming a pressure seal between the thermochemical reactor and the feedstock inlet;

(b) further advancing the primary ram in the primary cylinder and transferring a leading one of the plugs to a plug disintegrator assembly;

(c) breaking up said leading one of the plurality of plugs; and (d) transferring the broken-up plug into the pressurized thermochemical reactor.

19. The method according to claim 18, wherein:

the hydraulic feeder system further comprises a second piston cylinder assembly having a second piston ram occupying a second cylinder which connects to the primary cylinder at a primary branch opening;

the feedstock inlet is connected to the primary cylinder via the second cylinder; and the method further comprises:

(a1) after step (a) and prior to further advancing the primary ram in the primary cylinder, closing a passage between the feedstock inlet and the primary cylinder with the second piston ram.

* * * * *